US012414607B2

(12) United States Patent
Siegismund

(10) Patent No.: US 12,414,607 B2
(45) Date of Patent: Sep. 16, 2025

(54) ARTICLE OF FOOTWEAR HAVING A CLOSURE SYSTEM

(71) Applicant: PUMA SE, Herzogenaurach (DE)

(72) Inventor: Andreas Siegismund, Rueckersdorf (DE)

(73) Assignee: PUMA SE, Herzogenaurach (DE)

( * ) Notice: Subject to any disclaimer, the term of this patent is extended or adjusted under 35 U.S.C. 154(b) by 154 days.

(21) Appl. No.: 18/199,497

(22) Filed: May 19, 2023

(65) Prior Publication Data

US 2023/0371649 A1 Nov. 23, 2023

Related U.S. Application Data

(60) Provisional application No. 63/344,957, filed on May 23, 2022.

(51) Int. Cl.

| | |
|---|---|
| ***A43C 11/20*** | (2006.01) |
| ***A43B 23/02*** | (2006.01) |
| ***A43C 11/16*** | (2006.01) |

(52) U.S. Cl.

CPC ..... *A43B 23/0245* (2013.01); *A43C 11/165* (2013.01); *A43C 11/20* (2013.01)

(58) Field of Classification Search

CPC ..... A43C 11/00; A43C 11/08; A43C 11/16; A43C 11/165; A43C 11/20; A43B 5/0474; A43B 11/00

See application file for complete search history.

(56) References Cited

U.S. PATENT DOCUMENTS

| | | | | |
|---|---|---|---|---|
| 5,060,403 | A * | 10/1991 | Battistella | A43B 5/048 36/118.1 |
| 6,324,774 | B1 | 12/2001 | Zebe, Jr. | |
| 7,386,947 | B2 * | 6/2008 | Martin | A43B 5/0447 36/117.6 |
| 2008/0172848 | A1 * | 7/2008 | Chen | A43C 11/165 24/68 SK |
| 2012/0246897 | A1 * | 10/2012 | Lee | A43C 1/003 24/713.5 |
| 2014/0290016 | A1 | 10/2014 | Lovett | |
| 2015/0059206 | A1 * | 3/2015 | Lovett | A43C 3/00 12/142 R |
| 2015/0237962 | A1 * | 8/2015 | Soderberg | A43C 11/14 24/71 SK |
| 2017/0245595 | A1 * | 8/2017 | Ramos | A43C 1/04 |

FOREIGN PATENT DOCUMENTS

WO 2020178869 A1 9/2020

OTHER PUBLICATIONS

International Search Report and Written Opinion of International Application No. PCT/IB2023/055199, mailed Nov. 10, 2023 (17 pages).

* cited by examiner

*Primary Examiner* — Ted Kavanaugh
(74) *Attorney, Agent, or Firm* — Quarles & Brady LLP

(57) ABSTRACT

An article of footwear includes an upper and a sole structure defining a central plane that extends through a toe end and a heel end, a plurality of retainers arranged along the upper and intersected by the central plane, and a cord including a first segment and a second segment. The cord is configured to engage the plurality of retainers to adjust a tightness of the footwear, such that at least one retainer of the plurality of retainers is not engaged by the cord.

19 Claims, 13 Drawing Sheets

ARTICLE OF FOOTWEAR HAVING A CLOSURE SYSTEM

CROSS REFERENCE TO RELATED APPLICATIONS

This application claims the benefit of and priority to U.S. Provisional Application No. 63/344,957, filed on May 23, 2022, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a closure system, and more specifically, a closure system including a disc pulley fastener mechanism.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms. One common closure mechanism to tighten the upper and the tongue onto a user's foot is by using shoelaces. Although shoelaces certainly provide a closure mechanism, shoelaces can break or become untied. Further, shoelaces can become loose over time, and thereby become less aesthetically appealing. Therefore, there is a need for an article of footwear that can selectively provide a tight fit of the upper and the tongue on the user's foot, and selectively provide a looser fit of the upper and the tongue on the user's foot that utilizes no shoelaces.

SUMMARY

An article of footwear, as described herein, may have various configurations. The article of footwear may have an upper and a sole structure connected to the upper.

In some aspects, an article of footwear includes an upper attached to a sole structure having a midfoot region, a heel region, a medial side, and a lateral side. The upper includes a tongue positioned in the midfoot region. The tongue has a plurality of retainers including a lower retainer having a first notch and a second retainer having a second notch. A medial pulley and a lateral pulley are positioned in the heel region and secured to the medial side and the lateral side of the upper respectively. A cord has a closed loop, and the first notch and the second notch are configured to selectively receive the closed loop. A first configuration of the cord is defined as the closed loop is guided to be received in the medial pulley, the lateral pulley, the first notch, and the second notch.

In some aspects, an article of footwear includes an upper and a sole structure defining a central plane that extends through a toe end and a heel end, a plurality of retainers arranged along the upper and intersected by the central plane, and a cord including a first segment and a second segment. The cord is configured to engage the plurality of retainers to adjust a tightness of the footwear, such that at least one retainer of the plurality of retainers is not engaged by the cord.

In some embodiments, a distance between the plurality of retainers and the sole structure varies from a first retainer to a second retainer. In some embodiments, the cord includes a first segment and a second segment that are selectively engaged with the plurality of retainers. In a first configuration, the cord is configured to engage the first retainer. Further, the first segment and the second segment are both configured to engage the first retainer. In a second configuration, the cord is configured to engage the first retainer and the second retainer. Further, the first segment is configured to engage the first retainer and the second segment is configured to engage the second retainer. In a third configuration, the cord is configured to engage the second retainer. Further, the first segment and the second segment are both configured to engage the second retainer. In some embodiments, the first segment and the second segment of the cord are connected to one another to form a closed loop.

In some aspects, an article of footwear includes an upper and a sole structure having a midfoot region disposed between a forefoot region and a heel region. A pulley is located in the heel region and rotatably attached to the upper. A cord is movably coupled to the pulley. The cord has a first segment and a second segment connected to one another to form a closed loop. The pulley and the cord are configured to adjust a tightness of the footwear.

In some embodiments, the pulley includes a first pulley disposed on a medial side of the upper and a second pulley disposed on a lateral side of the upper. In some embodiments, the at least one of the first pulley or the second pulley is configured to be translated within a slot formed in the upper. In some embodiments, the cord is configured to be selectively engaged with at least one retainer arranged on the upper.

In some aspects, an article of footwear includes an upper and a sole structure defining a central plane that extends through a toe end and a heel end, a plurality of retainers arranged along the upper, a pulley, and a cord. The plurality of retainers are spaced apart from one another and intersected by the central plane. The pulley is located in a heel region of the footwear and rotatably attached to the upper. The cord is configured to engage at least one of the plurality of retainers and the pulley to adjust a tightness of the footwear.

In some embodiments, the plurality of retainers are disposed in a midfoot region of the footwear. In some embodiments, the pulley is rotatable about an axis that is disposed closer to the sole structure relative to the plurality of retainers. In some embodiments, a distance is defined between the pulley is and each retainer of the plurality of retainers, the distance being varied across the plurality of retainers. In some embodiments, the cord is configured to be selectively engaged with two retainers of the plurality of retainers and moveably attached to the pulley. In some embodiments, the pulley includes a first pulley located on a medial side of the footwear and a second pulley located on a lateral side of the footwear, at least one of the first and second pulleys being configured to be translated and rotated on the upper.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
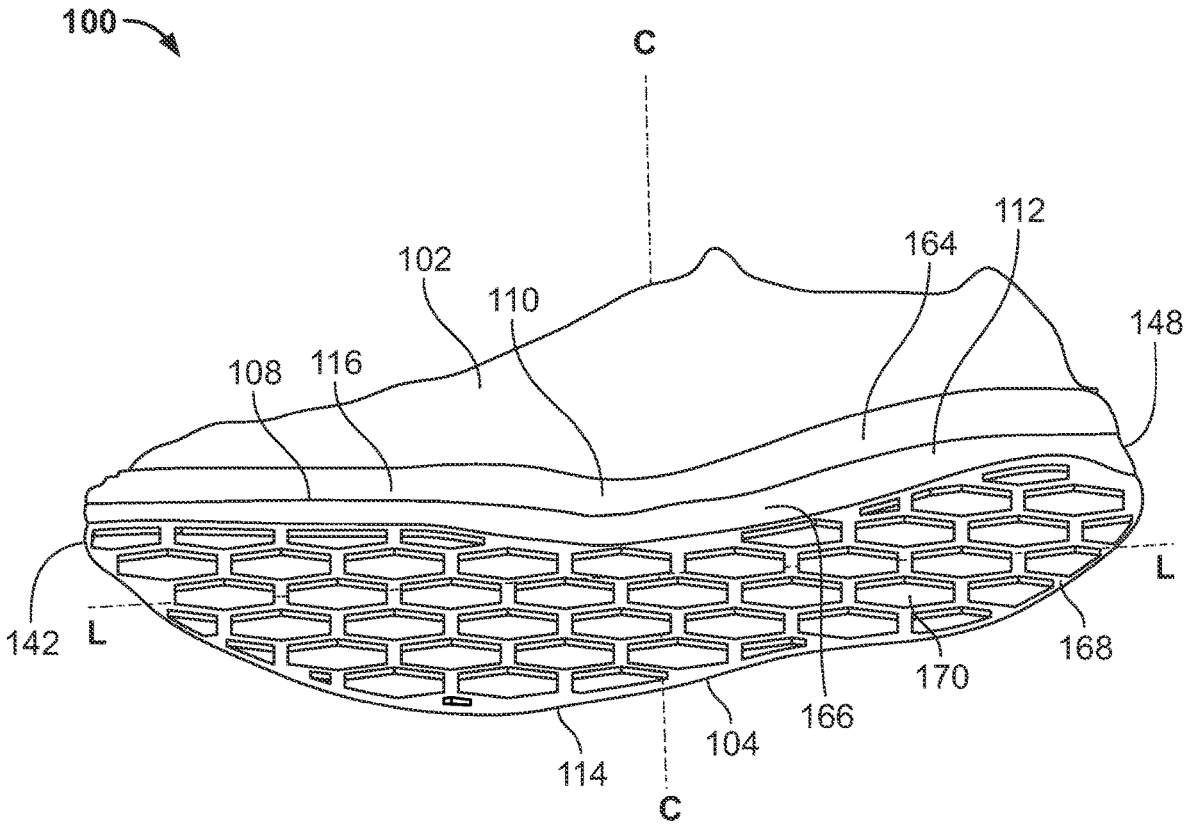
FIG. 1 is a perspective view of a bottom and medial side of an article of footwear configured as a left shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
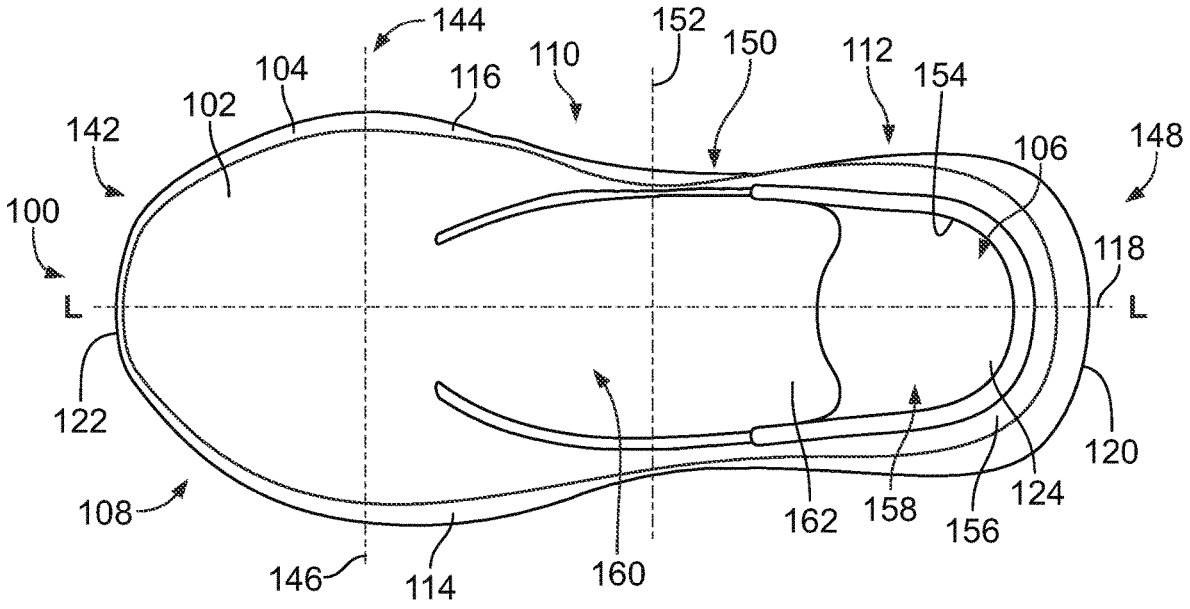
FIG. 2 is a top view of the article of footwear of FIG. 1.
Figure 3:
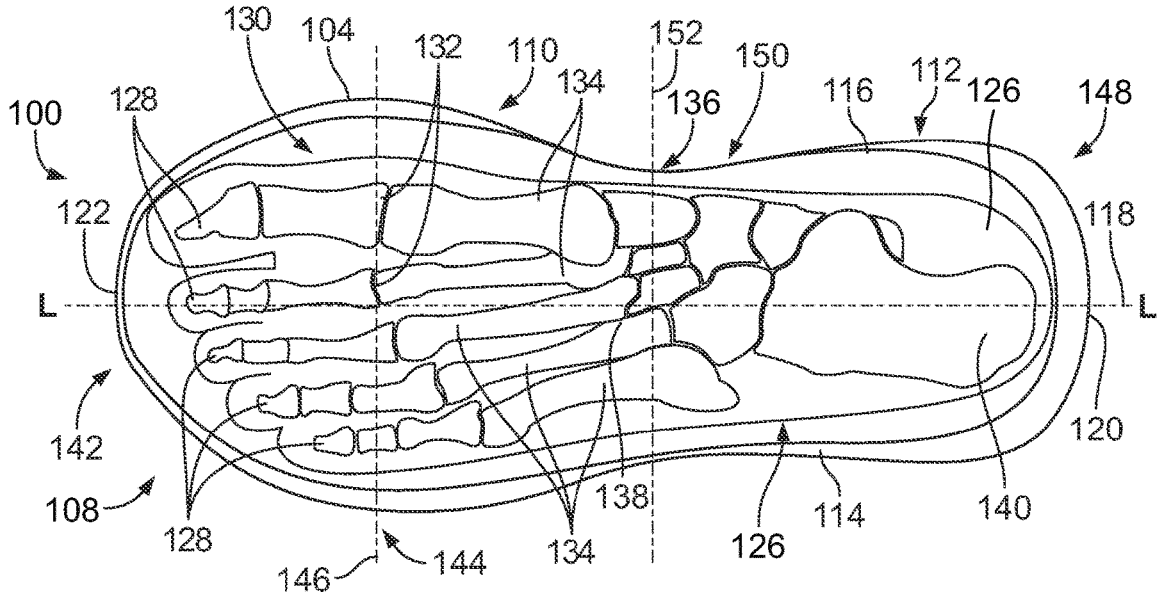
FIG. 3 is a top plan view of the article of footwear of FIG. 1 with the upper removed and a user's skeletal foot structure overlaid thereon.

FIGS. 1-3 depict an exemplary embodiment of an article of footwear 100 including an upper 102 (see FIGS. 1 and 2) and a sole structure 104. The upper 102 is attached to the sole structure 104 and together define an interior cavity 106 (see FIG. 2) into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

Referring to FIGS. 1 and 2, with reference to the material (s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

Still referring to FIGS. 1 and 2, in some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

The sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Still referring to FIGS. 1 and 2, furthermore, the insole can be positioned within the interior cavity of the upper, which can be in direct contact with a user's foot while an article of footwear is being worn. Moreover, an upper may also include a liner (not shown) that can increase comfort, for example, by reducing friction between the foot of the user and the upper, the sole, the insole, or the like, and/or by providing moisture wicking properties. The liner may line the entirety of the interior cavity or only a portion thereof. In some embodiments, a binding (not shown) may surround the opening of the interior cavity to secure the liner to the upper and/or to provide an aesthetic element on the article of footwear.

Referring to FIGS. 2 and 3, the article of footwear 100 also defines a lateral side 114 and a medial side 116. When a user is wearing the shoes, the lateral side 114 corresponds with an outside-facing portion of the article of footwear 100 while the medial side 116 corresponds with an inside-facing portion of the article of footwear 100. As such, the article of footwear 100 has opposing lateral sides 114 and medial sides 116. The medial side 116 and the lateral side 114 adjoin one another along a longitudinal central plane or central axis 118 of the article of footwear 100, which is coplanar with the longitudinal axis L of FIG. 1. As will be further discussed herein, the central axis 118 may demarcate a central, intermediate axis between the medial side 116 and the lateral side 114 of the article of footwear 100. Put differently, the central axis 118 may extend between a rear, proximal 120 of the article of footwear 100 and a front, distal 122 of the article of footwear 100 and may continuously define a middle of an insole 124, the sole structure 104, and/or the upper 102 of the article of footwear 100, i.e., the central axis 118 is a straight axis extending through the rear, proximal 120 of the heel region 112 to the front, distal 122 of the forefoot region 108.

Referring to FIG. 3, unless otherwise specified, the article of footwear 100 may be defined by the forefoot region 108, the midfoot region 110, and the heel region 112. The forefoot region 108 may generally correspond with portions of the article of footwear 100 that encase portions of a foot 126 that include a set of toes or phalanges 128, a ball of the foot 130, and a set of joints 132 that connect a set of metatarsals 134 of the foot 126 with the set of toes or phalanges 128. The midfoot region 110 is proximate and adjoins the forefoot region 108. The midfoot region 110 generally corresponds with portions of the article of footwear 100 that encase an arch 136 of the foot 126, along with a bridge 138 of the foot 126. The heel region 112 is proximate to the midfoot region 110 and adjoins the midfoot region 110. The heel region 112 generally corresponds with portions of the article of footwear 100 that encase rear portions of the foot 126, including a heel or calcaneus bone 140, an ankle (not shown), and/or an Achilles tendon (not shown).

Referring to FIGS. 1 and 2, the forefoot region 108, the midfoot region 110, the heel region 112, the medial side 116, and the lateral side 114 are intended to define boundaries or areas of the article of footwear 100. To that end, the forefoot region 108, the midfoot region 110, the heel region 112, the medial side 116, and the lateral side 114 generally characterize sections of the article of footwear 100. Certain aspects of the disclosure may refer to portions or elements that are coextensive with one or more of the forefoot region 108, the midfoot region 110, the heel region 112, the medial side 116, and/or the lateral side 114. Further, both the upper 102 and the sole structure 104 may be characterized as having portions within the forefoot region 108, the midfoot region 110, the heel region 112, and/or along the medial side 116 and/or the lateral side 114. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 116 and/or the lateral side 114.

Referring to FIGS. 2 and 3, the forefoot region 108, the midfoot region 110, the heel region 112, the medial side 116, and the lateral side 114 are shown in detail. The forefoot region 108 extends from a toe end 142 to a widest portion 144 of the article of footwear 100. The widest portion 144 is defined or measured along a first line 146 that is perpendicular with respect to the central axis 118 that extends from a distal portion of the toe end 142 to a distal portion of a heel end 148, which is opposite the toe end 142. The midfoot region 110 extends from the widest portion 144 to a thinnest portion 150 of the article of footwear 100. The thinnest portion 150 of the article of footwear 100 is defined as the thinnest portion of the article of footwear 100 measured across a second line 152 that is perpendicular with respect to the central axis 118. The heel region 112 extends from the thinnest portion 150 to the heel end 148 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 116, and/or the lateral side 114 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 116, and/or the lateral side 114 discussed herein.

Still referring to FIGS. 2 and 3, the medial side 116 begins at the distal, toe end 142 and bows outward along an inner side of the article of footwear 100 along the forefoot region 108 toward the midfoot region 110. The medial side 116 reaches the first line 146, at which point the medial side 116 bows inward, toward the central axis 118. The medial side 116 extends from the first line 146, i.e., the widest portion 144, toward the second line 152, i.e., the thinnest portion 150, at which point the medial side 116 enters into the midfoot region 110, i.e., upon crossing the first line 146. Once reaching the second line 152, the medial side 116 bows outward, away from the central axis 118, at which point the medial side 116 extends into the heel region 112, i.e., upon crossing the second line 152. The medial side 116 then bows outward and then inward toward the heel end 148, and terminates at a point where the medial side 116 meets the central axis 118.

The lateral side 114 also begins at the distal, toe end 142 and bows outward along an outer side of the article of footwear 100 along the forefoot region 108 toward the midfoot region 110. The lateral side 114 reaches the first line 146, at which point the lateral side 114 bows inward, toward the central axis 118. The lateral side 114 extends from the first line 146, i.e., the widest portion 144, toward the second line 152, i.e., the thinnest portion 150, at which point the lateral side 114 enters into the midfoot region 110, i.e., upon crossing the first line 146. Once reaching the second line 152, the lateral side 114 bows outward, away from the central axis 118, at which point the lateral side 114 extends into the heel region 112, i.e., upon crossing the second line 152. The lateral side 114 then bows outward and then inward toward the heel end 148 and terminates at a point where the lateral side 114 meets the central axis 118.

Referring to FIG. 2, the upper 102 extends along the lateral side 114 and the medial side 116, and across the forefoot region 108, the midfoot region 110, and the heel region 112 to house and enclose a foot of a user. When fully assembled, the upper 102 also includes an interior surface 154 and an exterior surface 156. The interior surface 154 faces inward and generally defines the interior cavity 106, and the exterior surface 156 of the upper 102 faces outward and generally defines an outer perimeter or boundary of the upper 102. The upper 102 also includes an opening 158 that is at least partially located in the heel region 112 of the article of footwear 100, which provides access to the interior cavity 106 and through which a foot may be inserted and removed. In some embodiments, the upper 102 may also include an instep region 160 that extends from the opening 158 in the heel region 112 over an area corresponding to an instep of a foot to an area proximate the forefoot region 108. The instep region 160 may comprise an area similar to where a tongue 162 of the present embodiment is disposed. In some embodiments, the upper 102 does not include the tongue 162, i.e., the upper 102 is tongueless.

Referring to FIG. 1, the sole structure 104 includes a midsole 164 and an outsole 166. The outsole 166 may define a bottom end or bottom surface 168 of the sole structure 104 across the heel region 112, the midfoot region 110, and the forefoot region 108. Further, the outsole 166 may be a ground-engaging portion or include a ground-engaging surface of the sole structure 104 and may be opposite of the insole thereof. As illustrated in FIG. 1, the bottom surface 168 of the outsole 166 may include a tread pattern 170 that can include a variety of shapes and configurations. The outsole 166 may be formed from one or more materials to impart durability, wear-resistance, abrasion resistance, or traction to the sole structure 104. In some embodiments, the outsole 166 may be formed from any kind of elastomer material, e.g., rubber, including thermoset elastomers or thermoplastic elastomers, or a thermoplastic material, e.g., thermoplastic polyurethane (TPU). In some embodiments, the outsole 166 may define a shore A hardness up to 95. In addition, the outsole 166 may be manufactured by a process involving injection molding, vulcanization, printing layer by layer, i.e., additive manufacturing systems or methods, and the like.

The midsole 164 may be individually constructed from a thermoplastic material, such as polyurethane (PU), for example, and/or an ethylene-vinyl acetate (EVA), copolymers thereof, or a similar type of material. In other embodiments, the midsole 164 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 164 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 164 is manufactured by a process involving injection molding, vulcanization, printing layer by layer, i.e., additive manufacturing systems or methods, and the like.

Referring to FIG. 1, in the embodiments where the midsole 164 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 164 may be formed using alternative methods known in the art, including the use of an expansion press, an injection machine, a pellet expansion process, a cold foaming process, a compression molding technique, die cutting, or any combination thereof. For example, the midsole 164 may be formed using a process that involves an initial foaming step in which supercritical gas is used to foam a material and then compression molded or die cut to a particular shape.

Figure 4:
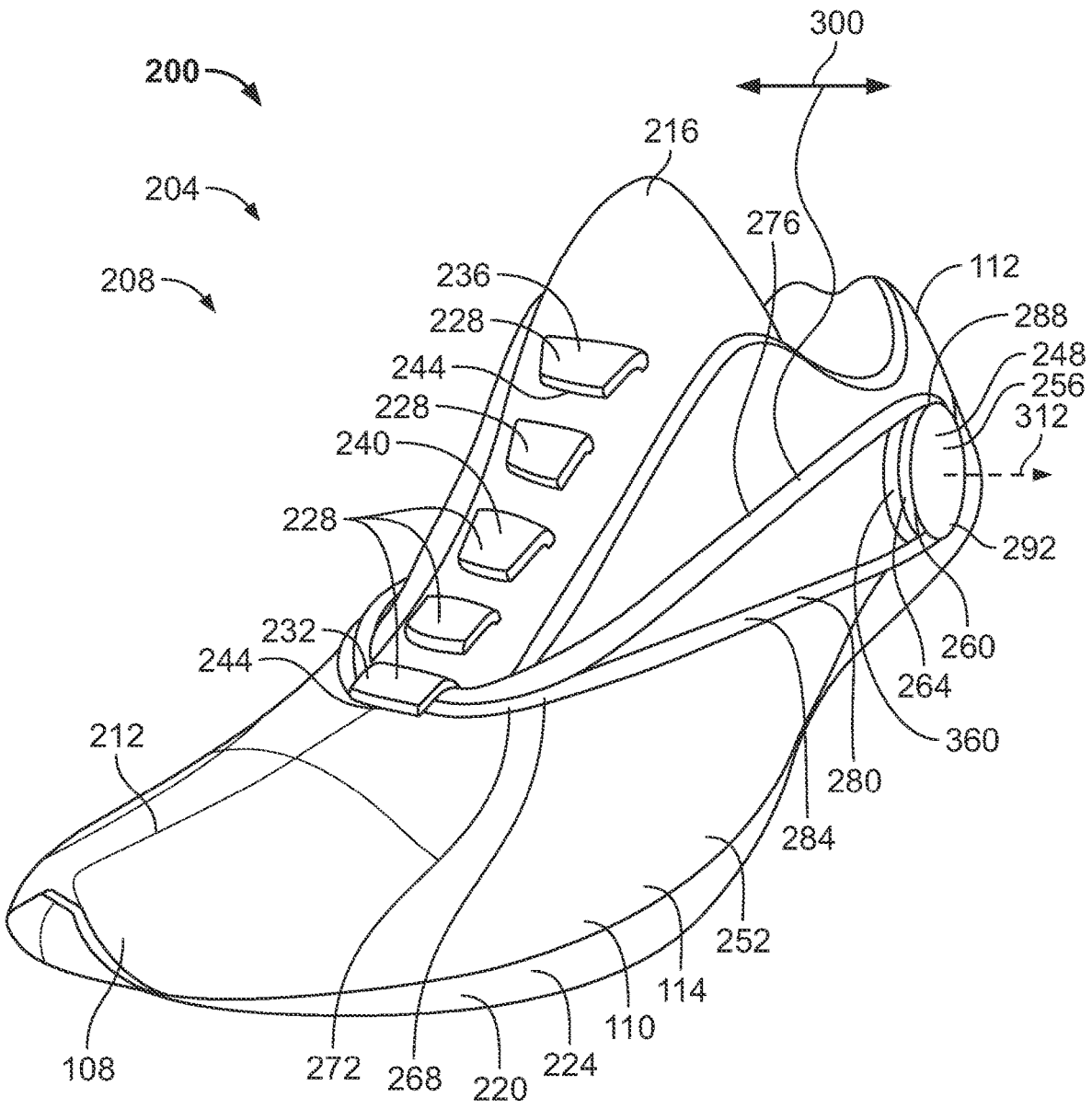
FIG. 4 is a schematic representation of a perspective view of the lateral side of an article of footwear configured as a left shoe, with a fastener system shown, according to an embodiment of the present disclosure.

Referring to FIG. 4, another embodiment of an article of footwear 200 having a fastener system 204 is configured as a left shoe 208 and includes an upper 212 with a tongue 216, a midsole 220, and an outsole 224. The tongue 216 includes a plurality of retainers 228 arranged in the form of an array including a first or lowermost retainer 232, and a second or uppermost retainer 236. The lowermost retainer 232 is disposed a shorter distance from the sole structure 104 than the uppermost retainer 236, such that the plurality of retainers 228 vary in elevation relative to one another. Each of the plurality of retainers 228 has a first or retainer body 240 that includes a first or notch surface 244. Each of the notch surfaces 244 is configured to be concave shaped and face toward the forefoot region 108.

The plurality of retainers 228 are spaced apart from one another in the longitudinal direction, i.e., parallel with the central axis 118. In some embodiments, each of the retainers 228 is arranged along the midfoot region 110 and intersected by the central plane of the central axis 118 (see FIGS. 2 and 3). In some embodiments, at least one of the plurality of retainers 228 is offset toward the lateral side 114 or the medial side 116 and is not intersected by the central plane of the central axis 118. In some embodiments, at least one of the plurality of retainers 228 is located in the forefoot region 108 or the heel region 112. In some embodiments, at least one of the plurality of retainers 228 is located on the sole structure 104. A first or lateral or pulley 248 is shown in the heel region 112 facing the lateral side 114 of the article of footwear 200. The pulley 248 is retained along a second or outward surface 252 of the upper 212. The pulley 248 includes a second or pulley body 256 which has a third or circumferential surface 260 which is perpendicular to the outward surface 252. The circumferential surface 260 defines a first or pulley channel 264.

A cord 268 has a third or cord body 272 that includes a first or upper segment 276 and a second or lower segment 280. The cord 268 is configured to be flexible and capable of transmitting tension or tensile forces. In some embodiments, the cord 268 is configured as a closed loop 284. That is, the cord 268 is provided as a continuous band and has no free ends. In some embodiments, the cord 268 is provided as a strand and has free ends (not shown). The closed loop 284 of the cord 268 is configured to be received in the pulley channel 264 such that the upper segment 276 extends from the pulley channel 264 toward the plurality of retainers 228 from a first or high end 288 of the pulley 248, and the lower segment 280 extends from the pulley channel 264 toward the plurality of retainers 228 from a second or low end 292 of the pulley 248. The low end 292 of the pulley 248 is positioned closer to, i.e., a shorter distance from, the outsole 224 than the high end 288 of the pulley 248. The upper segment 276 and the lower segment 280 are configured to be retained or received on the notch surface 244 by any of the plurality of retainers 228.

Figure 5:
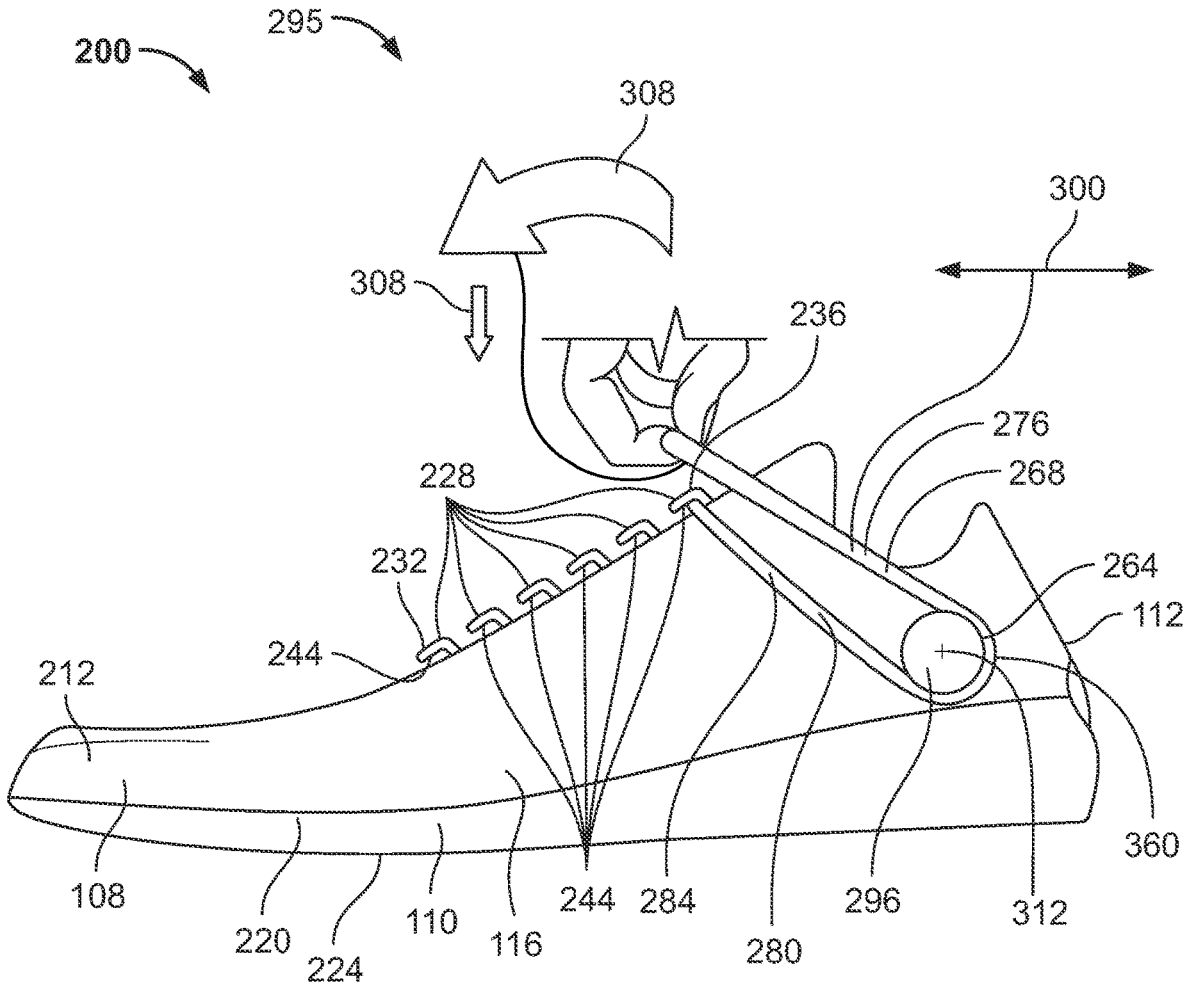
FIG. 5 is a side view of the article of footwear of FIG. 4 configured as a right shoe, illustrating a cord being adjusted by a user.

Referring to FIG. 5, which depicts the medial side 116 of the article of footwear 200 configured as a right shoe 295, a second or medial pulley 296 is disposed on the medial side 116 and illustrated as having identical but mirrored elements corresponding with those introduced as part of the lateral pulley 248 of the left shoe 208 of FIG. 4. The closed loop 284 of the cord 268 is received or retained on the pulley channel 264 of both the medial pulley 296 and the lateral pulley 248. Further, the upper segment 276 and the lower segment 280 of the cord 268 are secured or retained on one of the notch surfaces 244 of the plurality of retainers 228. In some embodiments, the closed loop 284 of the cord 268 is received in the pulley channel 264 of the medial pulley 296, the pulley channel 264 of the lateral pulley 248, and the notch surface 244 of at least one of the plurality of retainers 228. Accordingly, the cord 268 is stretched beyond its rest state, such that the cord 268 is in tension. As such, the cord 268 exerts pressure, i.e., compression, against the upper 212 of the article of footwear 200. Increasing the distance over which the cord 268 is stretched results in an increase in potential energy 300 stored in the tension of the cord 268. As the tension in the cord 268 increases, the amount of potential energy 300 increases. The tension in the cord 268 produces a compression force on the article of footwear 200, such as in the midfoot region 110, thereby tightening the article of footwear 200 to the user's foot. As the amount of the potential energy 300 stored in the cord 268 increases, the magnitude of the compression in the midfoot region 110 increases. Referring to FIG. 5, the upper segment 276, the lower segment 280, or both can be removed from one of the notch surfaces 244 and moved to another of the notch surfaces 244 by a first movement 308.

Figure 6:
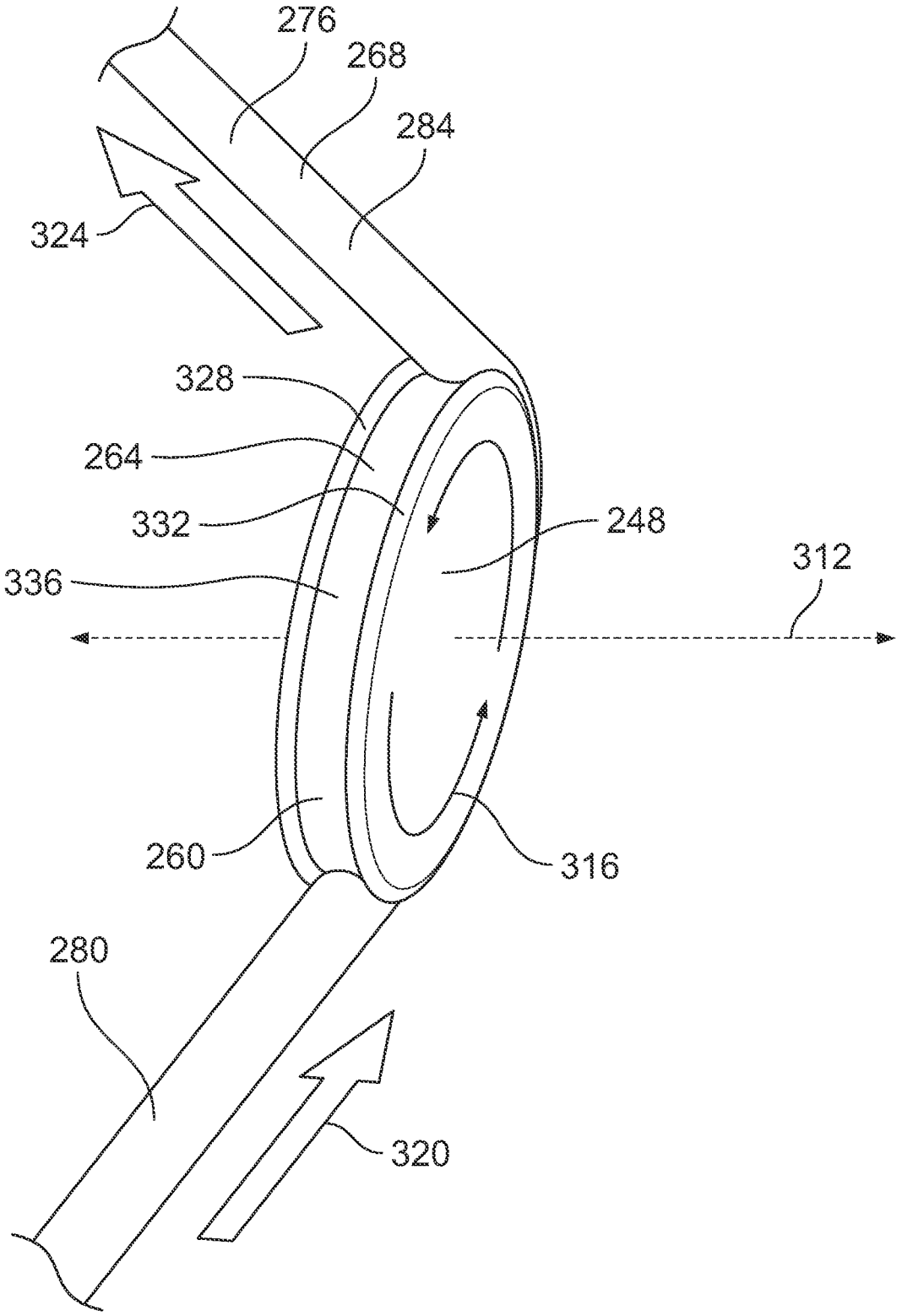
FIG. 6 is a schematic representation of a perspective view of a pulley suitable for use with the article of footwear of FIG. 4.

Referring to FIG. 6, the pulley 248 is configured to rotate about a first or pulley axis 312 and is capable of a rotation 316 when subjected to rotational force. In the illustrated embodiment, the pulley 248 is rotatably attached to the upper 102. In some embodiments, the pulley 248 is rotatably attached to the sole structure 104. The lower segment 280 and the upper segment 276 of the cord 268 are movably coupled to the pulley 248. In the illustrated embodiment, the lower segment 280 and the upper segment 276 of the cord 268 can circulate toward or away from the pulley 248 by one of the lower segment 280 or upper segment 276 moving along a first or rearward direction 320 toward the pulley 248 and the other of the lower segment 280 or the upper segment 276 moving along a second or forward direction 324 away from the pulley 248. Accordingly, the cord 268 can circulate and prevent worn down segments of the cord 268 from forming, thereby tending to increase the longevity of the cord 268. Further, the pulley 248 can be configured to provide audible feedback, e.g., clicking noises, to indicate rotation and, therefore, adjustment to the user. In some embodiments, the pulley channel 264 includes a first or left sidewall 328 and a second or right sidewall 332 that are spaced between a fourth or receiving surface 336 positioned on the circumferential surface 260. The left sidewall 328, the right sidewall 332, and the receiving surface 336 are configured to facilitate the closed loop 284 of the cord 268 being received in the pulley channel 264.

Figure 7:
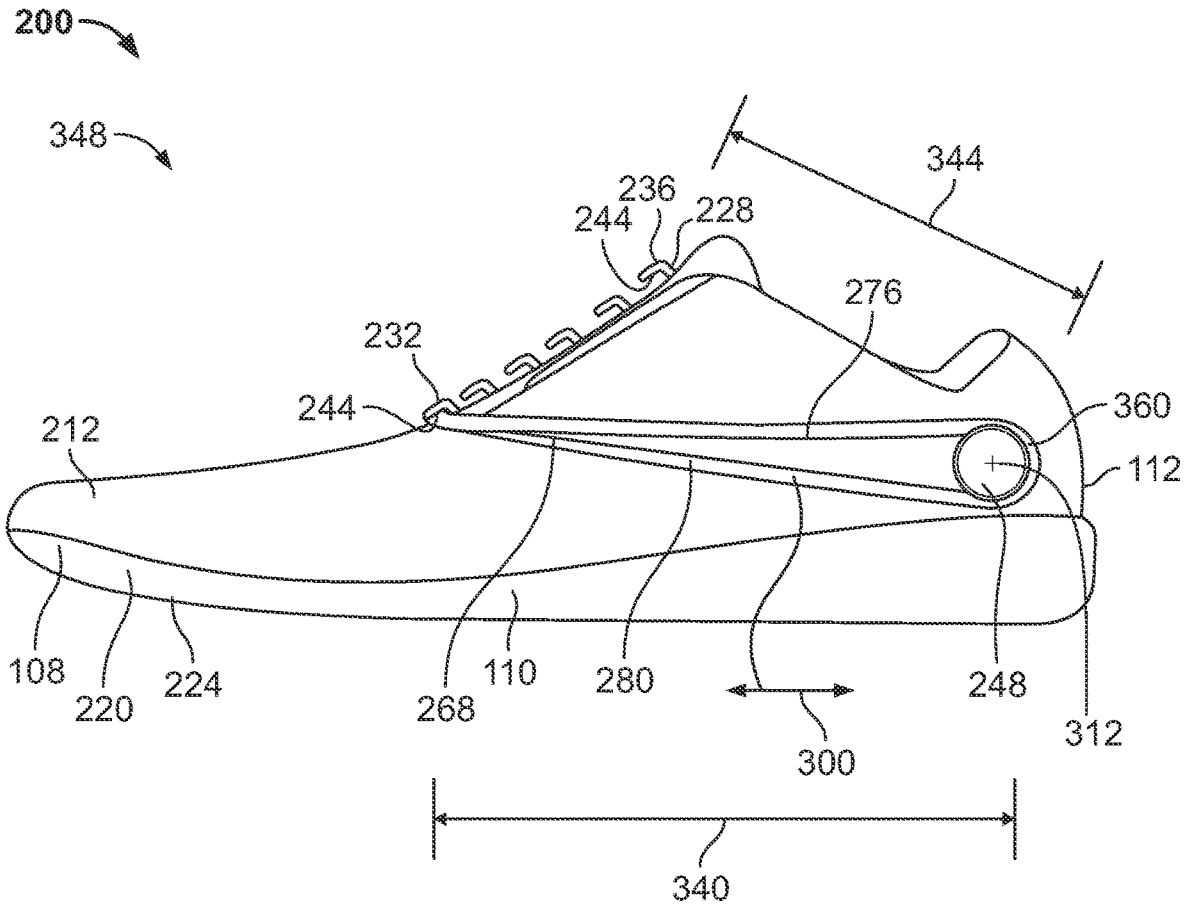
FIG. 7 is a schematic representation of a side view of the article of footwear of FIG. 4, illustrating a first arrangement of the cord.

Referring to FIG. 7, the notch surface 244 of the lowermost retainer 232 is a first or longer distance 340 from the pulley axis 312, and the notch surface 244 of the uppermost retainer 236 is a second or shorter distance 344 from the pulley axis 312. The longer distance 340 is longer than the shorter distance 344. As the cord 268 is stretched more, the cord 268 tends to transmit more tension when the upper segment 276 and the lower segment 280 are secured or retained by the notch surface 244 of the lowermost retainer 232. The tension transmitted by the cord 268 is increased, more of the potential energy 300 is stored in the cord 268, and the magnitude of the compression in the midfoot region 110 increases as one or both of the upper segment 276 and the lower segment 280 is retained on the notch surface 244 of the lowermost retainer 232.

Figure 8:
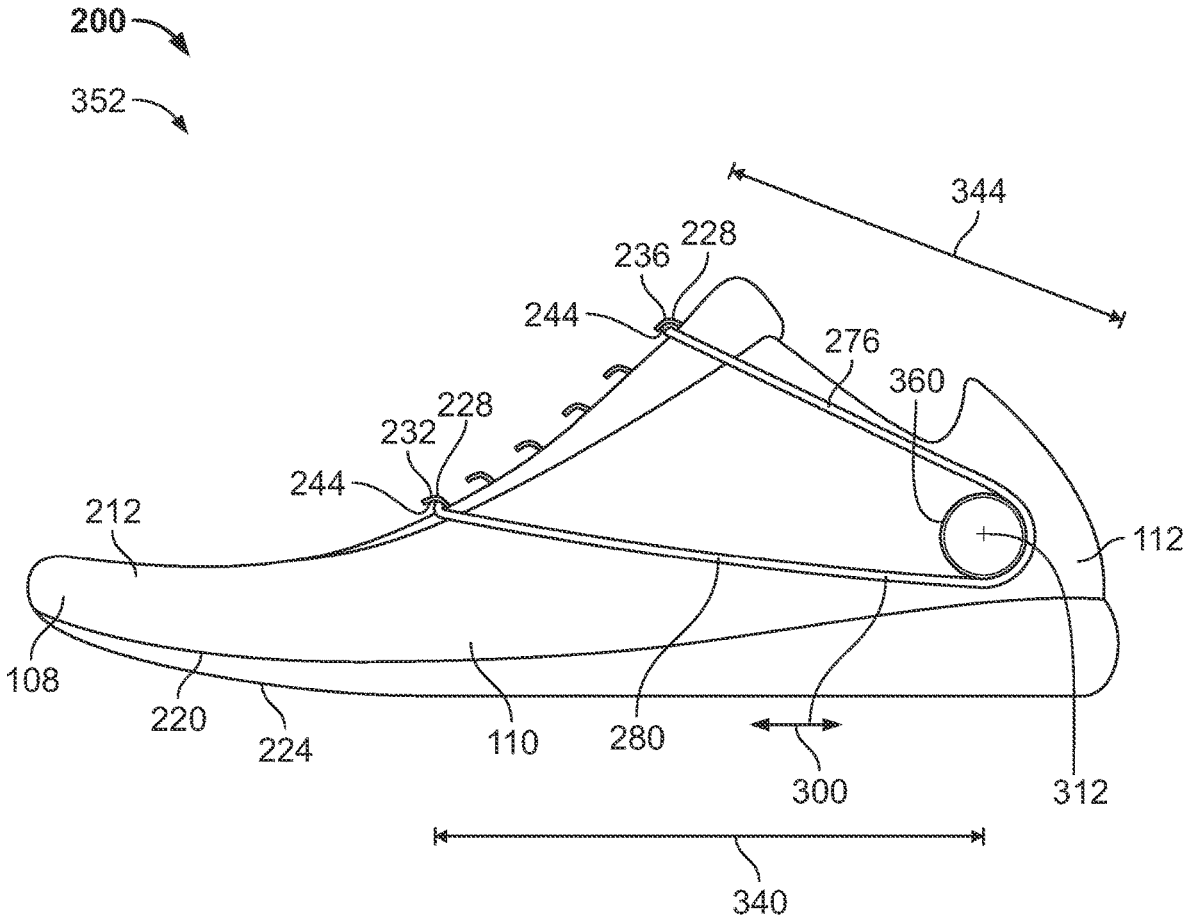
FIG. 8 is a schematic representation of a side view of the article of footwear of FIG. 4, illustrating a second arrangement of the cord.
Figure 9:
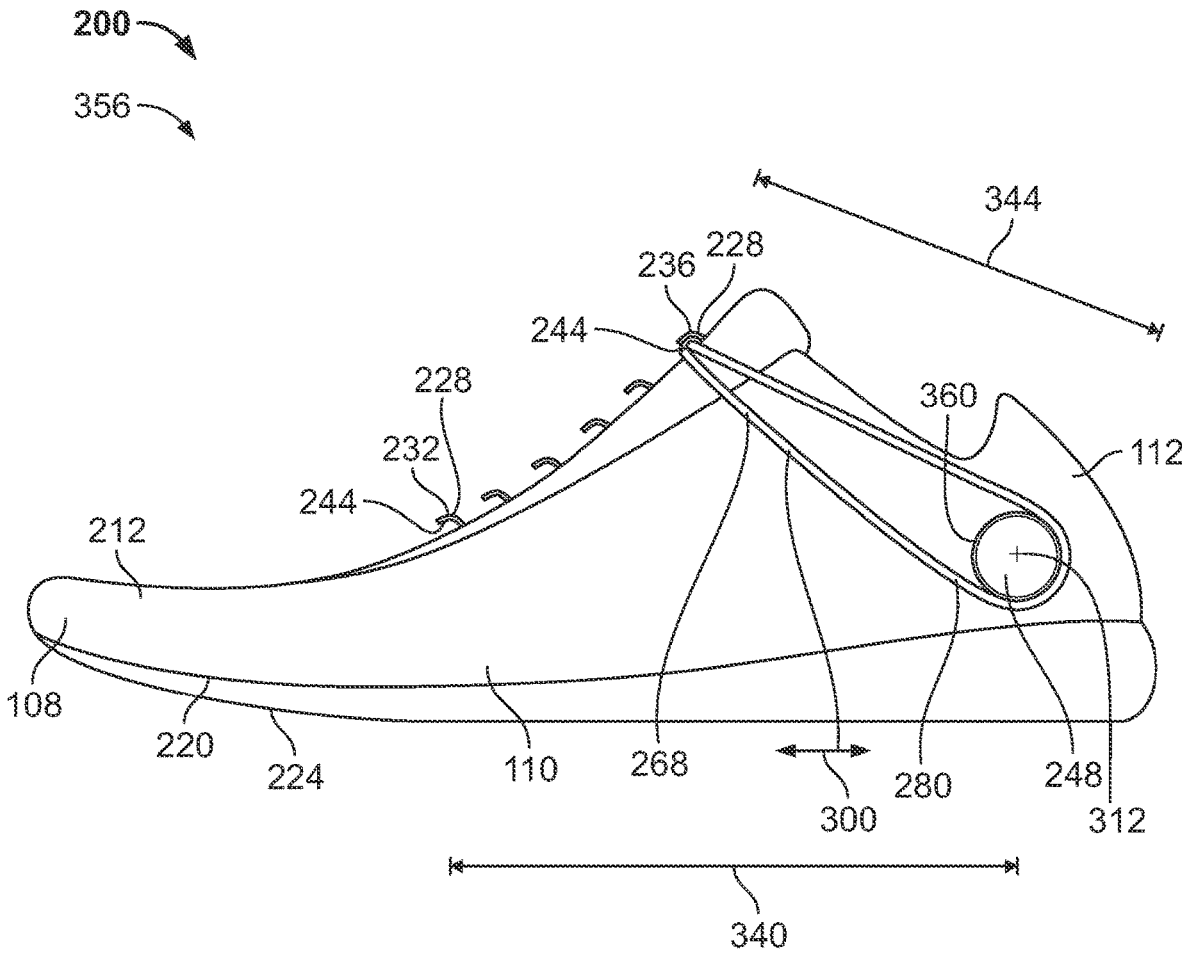
FIG. 9 is a schematic representation of a side view of the article of footwear of FIG. 4, illustrating a third arrangement of the cord.

Referring to FIG. 7, a first configuration 348 of the cord 268 has the upper segment 276 and the lower segment 280 retained on the notch surface 244 of the lowermost retainer 232. In a second configuration 352 of the cord 268, as illustrated in FIG. 8, one of the lower segment 280 or the upper segment 276 is retained on the notch surface 244 of the lowermost retainer 232, and the other of the lower segment 280 and the upper segment 276 is retained on the notch surface 244 of the uppermost retainer 236. In a third configuration 356 of the cord 268, as illustrated in FIG. 9, both of the lower segment 280 and the upper segment 276 are retained on the notch surface 244 of the uppermost retainer 236. Accordingly, in each of the first configuration 348, the second configuration 352, and the third configuration 356, the cord 268 is configured to engage fewer than all of the plurality of retainers 228. Put another way, the cord 268 is configured to engage the plurality of retainers 228 such that at least one retainer is not engaged by the cord 268. Accordingly, each retainer of the plurality of retainers 228 is in a binary operation state of either being selectively engaged or disengaged. In the first configuration 348, the cord 268 is selectively engaged with the lowermost retainer 232, such that only one retainer of the plurality of retainers 228 is in the engaged state. In the illustrated embodiment, the plurality of retainers 228 includes a quantity of five and, thus, the first configuration 348 corresponds with 80% of the retainers being in the disengaged state. In the second configuration 352, the cord 268 is selectively engaged with the lowermost retainer 232 and the uppermost retainer 236, such that two of the retainers of the plurality of retainers 228 are engaged. In the illustrated embodiment, the second configuration 352 corresponds with 60% of the plurality of retainers being in the disengaged state. It is contemplated that the plurality of retainers 228 may include any total number of retainers and, thus, the percentages of disengaged and engaged retainers may vary as a function of the total number.

Turning back to FIG. 7, the first configuration 348 has a higher magnitude of potential energy 300 stored in the cord 268 than the potential energy 300 stored in the cord 268 in the second configuration 352 (see FIG. 8). Further, the magnitude of the potential energy 300 stored in the cord 268 is greater than a magnitude of the potential energy 300 stored in the cord 268 in the third configuration 356 (see FIG. 9). Accordingly, the compression within the midfoot region 110 of the footwear 200 in the first configuration 348 is greater than the compression within the midfoot region 110 in the second configuration 352, which is, in turn, greater than the compression within the midfoot region 110 in the third configuration 356. Therefore, one way to control, adjust and regulate the compression in the midfoot region 110 is by adjusting the particular notch surface 244 that the upper segment 276, the lower segment 280, or both is retained upon. In this way, the user can adjust the cord 268 among the first configuration 348 (see FIG. 7), the second configuration (see FIG. 8), and the third configuration (see FIG. 9) to select the level or magnitude of compression of the footwear 200. It is contemplated that greater or fewer configurations are possible, such as, e.g., a fourth configuration (not shown) which may include an arrangement in which at least one of the upper segment 276 and the lower segment 280 is received by one of the retainers 228 intermediate or between the uppermost retainer 236 and the lowermost retainer 232. As such, by providing the footwear 200 with the plurality of retainer 228 along the upper 212, the fastener system 204 is configured to allow for multiple levels of compression among different configurations or arrangements of the cord 268 relative to the plurality of retainers 228 and the pulleys 248, 296.

Figure 10:
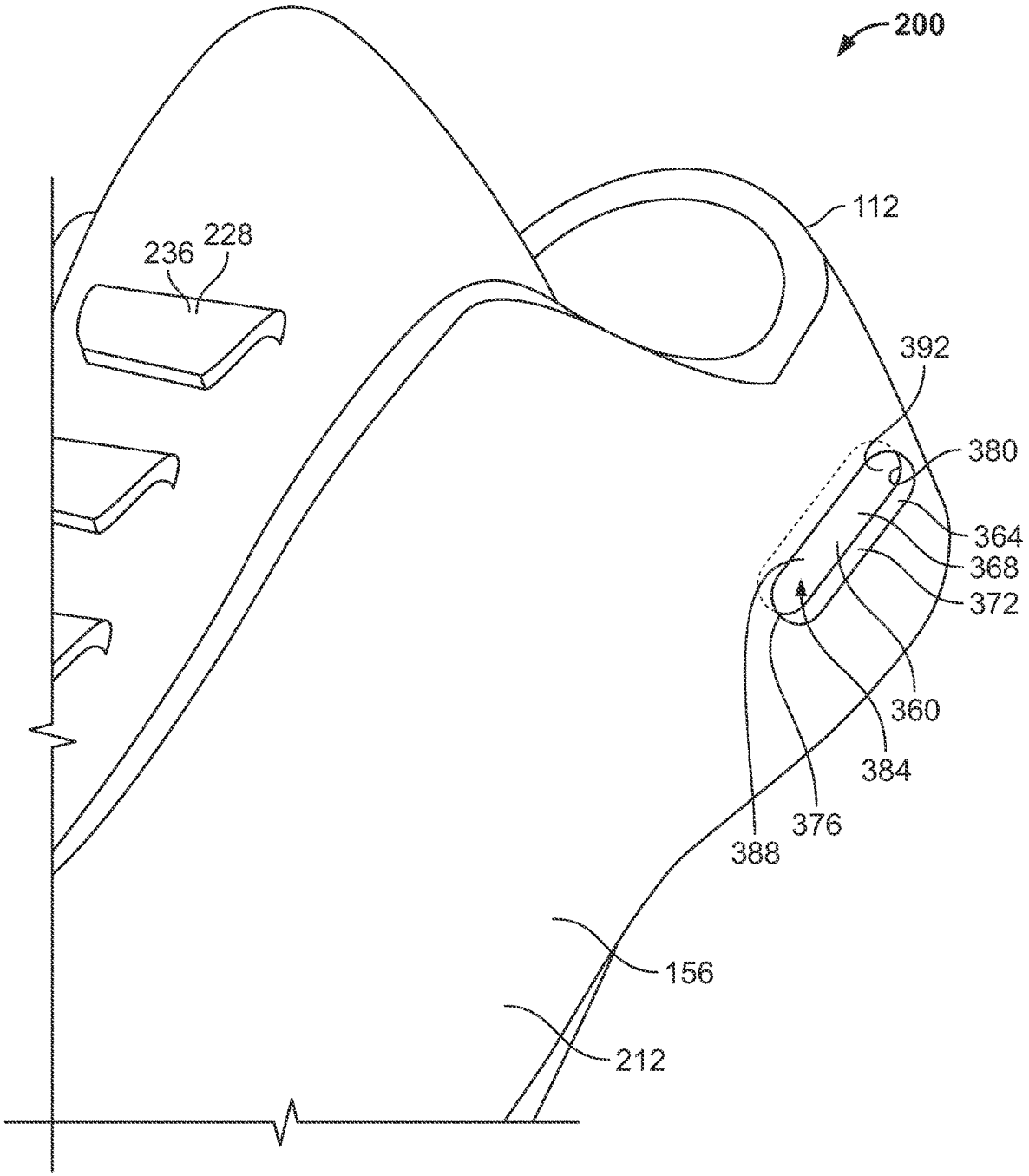
FIG. 10 is a schematic representation of a detailed view of the lateral side of the heel region of the article of footwear of FIG. 4 with the pulley and the cord hidden to illustrate an oval slot.

Referring the FIG. 10, in some embodiments, the article of footwear 200 includes an oval-shaped slot 360 positioned in, on, or within the upper 212 in the heel region 112 along either the medial side 116 (see FIG. 5) or the lateral side 114 (see FIG. 4) of the article of footwear 200. The slot 360 has a fourth or slot body 364 including a fifth or recessed surface 368 which is perpendicular to a sixth or sidewall surface 372. The sidewall surface 372 includes a first rounded end 376 and a second rounded end 380 located at opposite ends of the recessed surface 368. The recessed surface 368 and the sidewall surface 372 define a volume that forms an slot cavity 384 that is oval in shape. The slot cavity 384 is configured to retain the pulley 248 in at least a first or forward region 388 and a second or rearward region 392, which may be understood as forward and rearward areas or volumes formed by the slot 360. In some embodiments, the slot 360 is not present, and the pulley 248 is secured to the exterior surface 156 of the upper 212. In some embodiments, the pulley 248 can be configured to be placed in a forward position in the forward region 388, or in a rearward position within the rearward region 392, or the pulley 248 may translate, e.g., oscillate or slide, between the forward and rearward regions 388, 392. In some embodiments, the pulley 248 can be moved between the forward region 388 and the rearward region 392 by an actuator shaft 396 (see FIG. 12).

Figure 11:
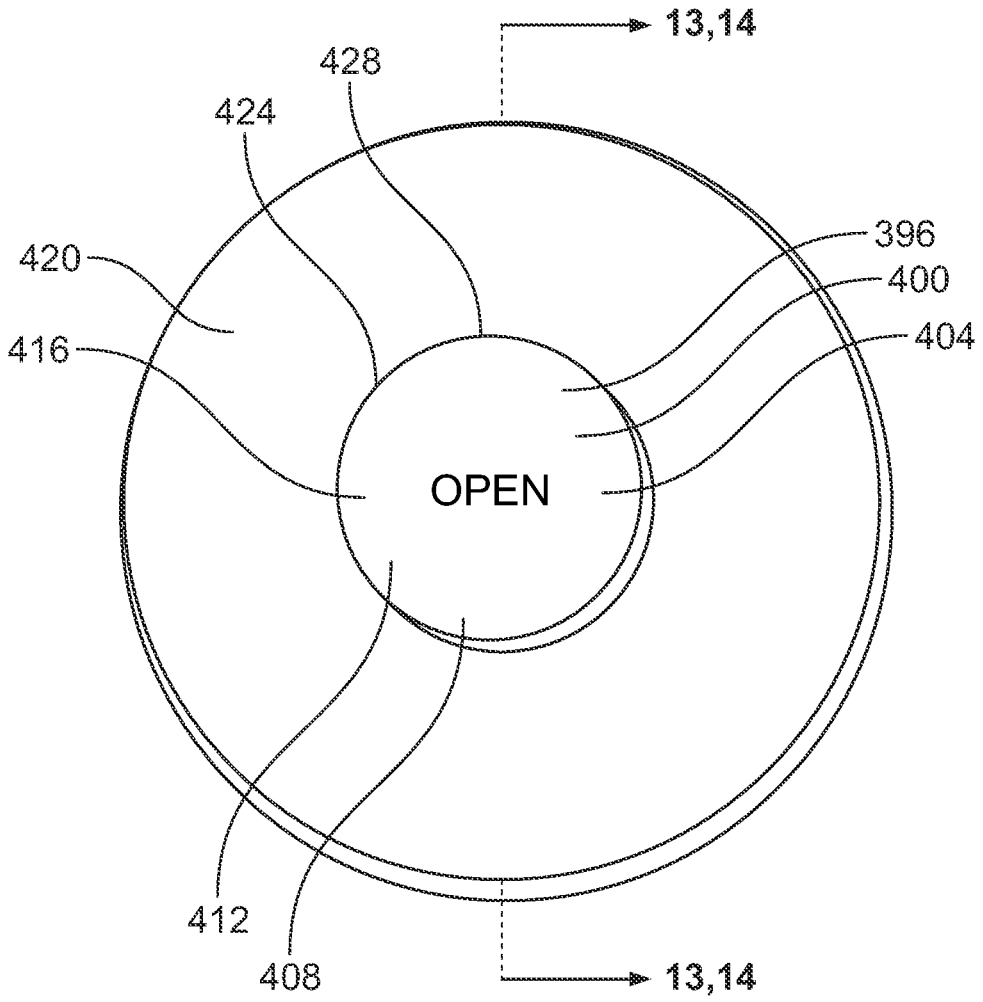
FIG. 11 is a schematic representation of a front view of an actuator shaft having an actuating mechanism with a shroud in an alternative embodiment of the article of footwear of FIG. 4.
Figure 12:
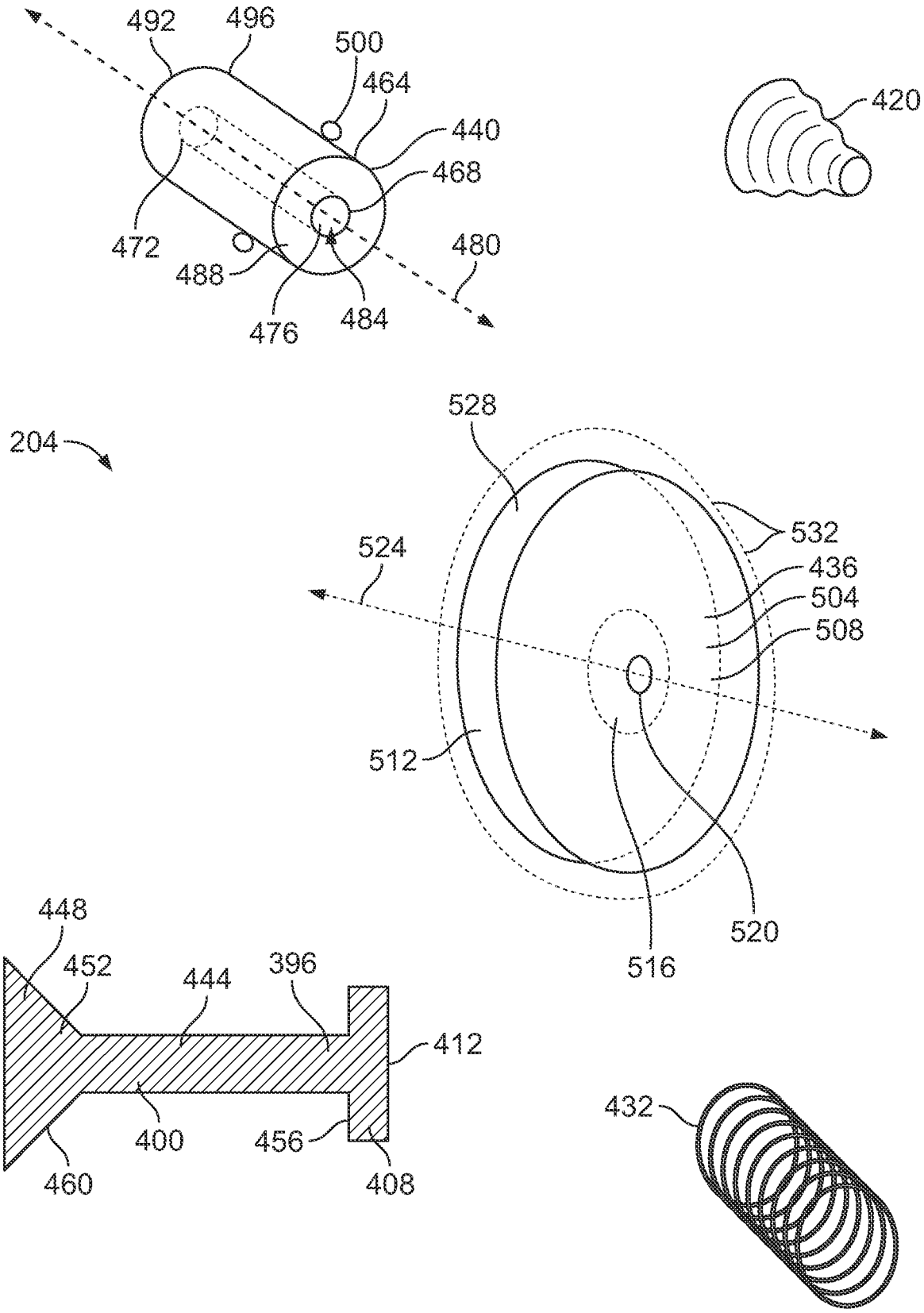
FIG. 12 is a schematic representation of an exploded perspective view of various parts utilized in the alternative embodiment of the article of footwear of FIG. 4.

Referring to FIGS. 11 and 12, an actuator mechanism 404 (see FIG. 11) includes the actuator shaft 396 and a fifth or shaft body 400 that is embodied as an actuator end 408 with a seventh or front surface 412. In some embodiments, the front surface 412 includes a marking or indicia 416 (see FIG. 11), such as the word "open." The indicia 416 may provide feedback to an end user about how to activate the actuator mechanism 404 of the fastener system 204 (see FIG. 4) embodied as the actuator end 408. In some embodiments, the actuator shaft 396 is secured to a flexible shroud 420 to form a first or shroud seal 424 (see FIG. 11) at a first or circumferential edge 428 (see FIG. 11). In some embodiments, the shroud 420 serves to block dust, debris, fluids, or other intrusions present within the surrounding environment. In some embodiments, the shroud 420 is a curved disc or plate, so that the shroud seal 424 can be maintained more easily and one or both of the shroud 420 and shroud seal 424 can be adorned with ornamental aspects, e.g., indicia or logos or markings.

Turning to FIG. 12, several elements of the fastener system 204 are shown, including the actuator shaft 396, the shroud 420, a spring 432, an elastic wedge 436, and a hollow axle 440. The actuator shaft 396 has the front surface 412 on the actuator end 408, which extends from an elongated shaft 444 that extends from a release mechanism 448 embodied as a release end 452. The actuator end 408 has an eighth or spring face surface 456 that faces in the opposite direction as the front surface 412. In some embodiments, the release end 452 has a frustoconical-shaped ninth or driving surface 460. In some embodiments, the release end 452 or the actuator end 408 is secured to the remainder of the actuator shaft 396 by threads, by adhesive, or by welding.

The hollow axle 440 has a sixth or axle body 464 with a first or front aperture 468 and a second or rear aperture 472 connected by a tenth or inner surface 476 which is concentrically arranged with a second or axle axis 480. An inner cavity 484 defines the volume between the front aperture 468, the rear aperture 472, and the inner surface 476. The hollow axle 440 has an eleventh or spring seat surface 488, a twelfth or wedge surface 492, and a thirteenth exterior surface 496, which faces radially away from the inner surface 476. The spring seat surface 488 faces away from the wedge surface 492. The exterior surface 496 of the hollow axle 440 is configured to retain the pulley 248 as the pulley 248 rotates. In some embodiments, the hollow axle 440 rotates with the pulley 248. In some embodiments, the pulley 248 rotates with respect to the hollow axle 440. The exterior surface 496 of the hollow axle 440 includes a plurality of shroud retainers 500. In some embodiments, the shroud 420 is configured to be retained by the plurality of shroud retainers 500. In some embodiments, the shroud 420 can rotate with respect to the plurality of shroud retainers 500. The shroud retainers 500 of the hollow axle 440 may be in contact with the shroud 420 to produce audible feedback, e.g., a clicking noise, during relative rotation therewith. Additionally or alternatively, the audible feedback may be produced by interaction between the shroud retainers 500 and the pulley 248. In some embodiments, the audible feedback is produced by interaction between the pulley 248 and the upper 102, or between the pulley 248 and the elastic wedge 426. In some embodiments, the audible feedback is produced by interaction between the actuator shaft 396 and one of the hollow axle 400, the elastic wedge 426, the spring 432, or the slot 360, or some combination thereof. In some embodiments, the audible feedback is a clicking sound that is produced by relative movement of opposing teeth or gears (not shown) provided between components, such that continuous relative movement produces a series of consecutive clicks that endure only as long as the relative movement occurs. The opposing teeth or gears (not shown) may further be provided as a locking mechanism to permit rotation in one direction, e.g., a tightening direction, and to prevent or resist rotation in the opposite direction, e.g., the loosening direction. In some embodiments, the elastic wedge 436 may be pressed against the pulley 248 by the actuator shaft 396 being acted upon by the spring 432, such that relative rotation of the pulley 248 and the elastic wedge 436 causes opposing teeth (not shown) provided thereon to interact with one another for producing the audible feedback and for preventing counter-rotation. Additionally or alternatively, the opposing teeth (not shown) can be provided between the elastic wedge 436 and the slot 360, or between the pulley 248 and the upper 102.

Still referring to FIG. 12, the elastic wedge 436 has a seventh or wedge body 504 that is a generally cylindrical shape, with a fourteenth or axle surface 508, a fifteenth or engagement surface 512, and a sixteenth or frustoconical surface 516. The elastic wedge 436 has a third or axial aperture 520 that is concentrically arranged about a third or wedge axis 524. The frustoconical surface 516 contacts the axle surface 508 at the axial aperture 520. In some embodiments, the axle surface 508 is perpendicular to the engagement surface 512. The elastic wedge 436 is made of an elastic material, such as, e.g., a flexible rubber or plastic, which allows the elastic wedge 436 to be squeezed or deformed into different shapes or sizes. The release mechanism 448 includes the driving surface 460 on the release end 452 of actuator shaft 396. When the driving surface 460 of the actuator shaft 396 is pressed into the frustoconical surface 516 of the elastic wedge 436, the elastic wedge 436 is compressed and distorts in shape. Accordingly, a closure mechanism 528 embodied as the engagement surface 512 of the elastic wedge 436 presses and expands radially outward from the wedge axis 524 to an extended position 532. The closure mechanism 528 is embodied by the extended position 532 of the engagement surface 512 of the elastic wedge 436.

Figure 13:
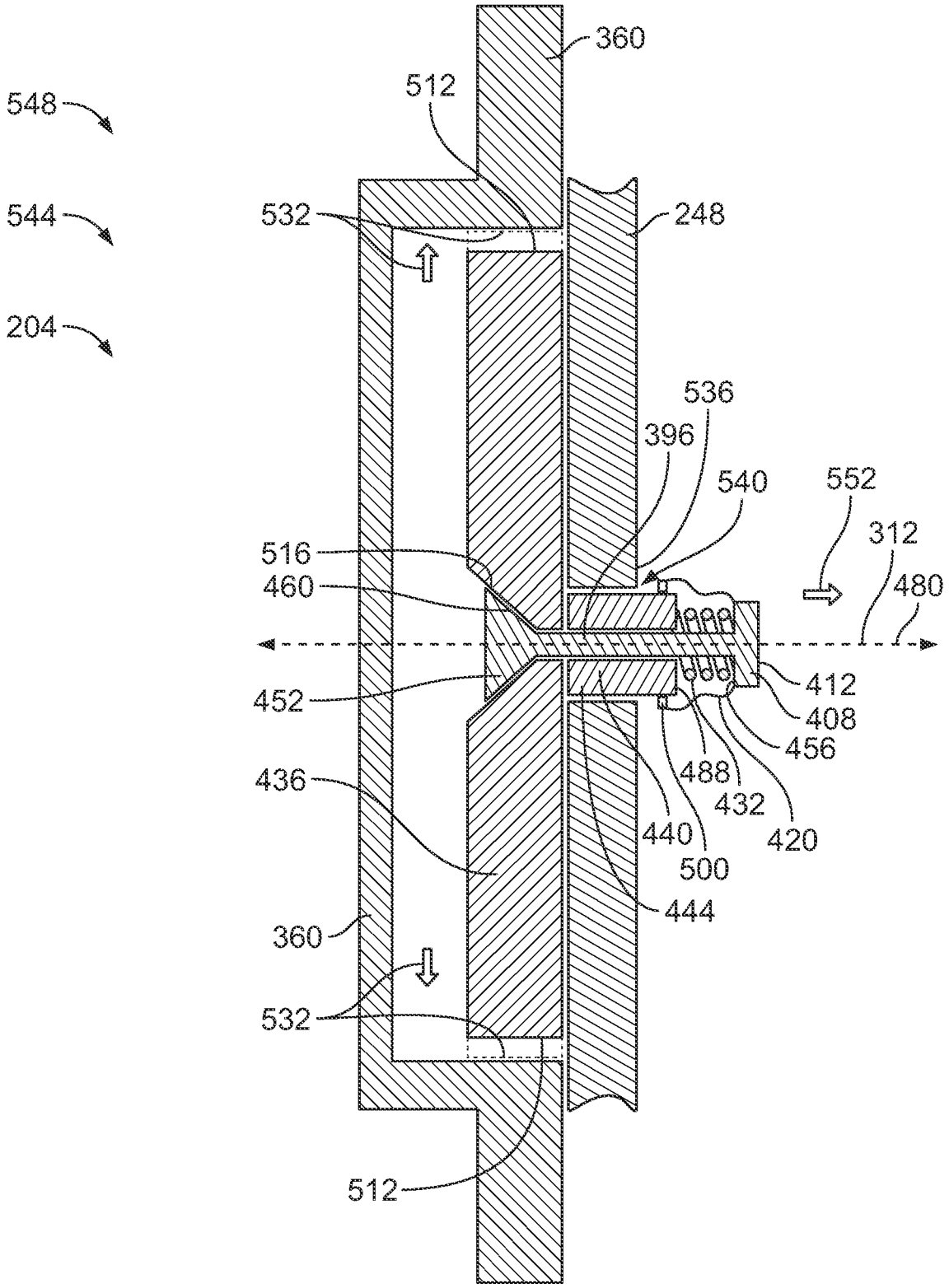
FIG. 13 is a schematic representation of a sectional view of the actuator shaft and the actuating mechanism with the shroud of FIG. 11 taken along the line 13-13 and depicted in a side view of the article of footwear of FIG. 4 with the fastener system configured in a locked configuration within the oval slot.
Figure 14:
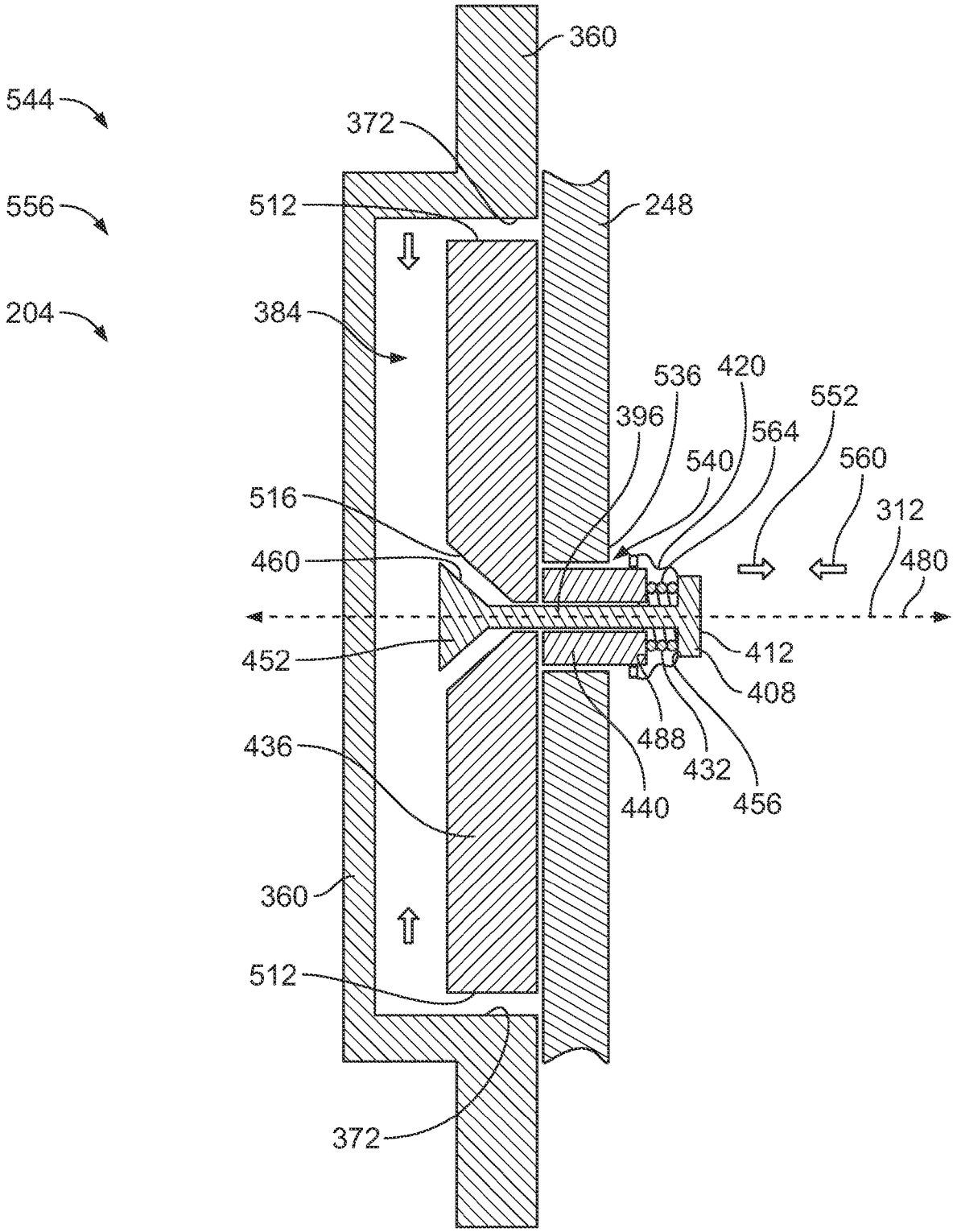
FIG. 14 is a schematic representation of a sectional view of the actuator shaft and the actuating mechanism with the shroud of FIG. 11 taken along the line 14-14 and depicted in a side view of the article of footwear of FIG. 4 with the fastener system configured in an unlocked configuration within the oval slot.

Referring to FIGS. 13 and 14, the fastener system 204 can facilitate the displacement of the pulley 248 between the forward region 388 (see FIG. 10) and the rearward region 392 (see FIG. 10) in the slot 360 (see FIG. 10). In some embodiments, the pulley 248 has a fourth or central aperture 536 that defines a central cavity 540. When the pulley 248 moves between the forward region 388 and the rearward region 392, the longer distance 340 (see FIG. 7) and the shorter distance 344 (see FIG. 7) change accordingly, which also changes the tension transmitted in the cord 268 (see FIG. 4) and, thus, results in a change to the magnitude of potential energy 300 (see FIG. 4) stored in the cord 268. As explained above, the change in potential energy 300 stored in the cord 268 is proportional to the magnitude of the compression within the midfoot region 110. Therefore, displacement of the pulley 248 between the forward region 388 and the rearward region 392 is proportional to the magnitude of compression exerted by the cord 268 within the midfoot 110. That is, the compression in the midfoot region 110 can be modified in two different and independent methods, the first method being the adjustment among the configurations of FIGS. 7-9, and the second method being the displacement of the pulley 248 within the slot 360.

When the notch surface 244 selected for the upper segment 276 or lower segment 280 is changed, the tension transmitted by the cord 268 is changed. Alternatively, or in addition, when the lateral pulley 248 or the medial pulley 296 (see FIG. 5) is moved between the forward position in the forward region 388 and the rearward position in the rearward region 392, the longer distance 340 and the shorter distance 344 change, and the tension transmitted by the cord 268 is changed. In some embodiments, neither of the medial pulley 296 or the lateral pulley 248 can move between the forward region 388 and the rearward region 392, and the position of the two pulleys 248, 296 is fixed. In some embodiments, one of the medial pulley 296 or the lateral pulley 248 is in a fixed position, and the other pulley 296, 248 can be moved between the forward region 388 and the rearward region 392. In some embodiments, both of the pulleys 248, 296 can be moved between the forward region 388 and the rearward region 392 to vary the tension in the cord 268 between maximum and a minimum values. To facilitate the movement of the fastener system 204 (see FIG. 4) between the forward region 388 and the rearward region 392, the actuator shaft 396, the pulley 248, the hollow axle 440, the spring 432, the shroud 420, and the elastic wedge 436 are assembled as an assembly 544, and inserted into the slot cavity 384.

Referring to FIG. 13, the assembly 544 is in a locked configuration 548 when the elongated shaft 444 of the actuator shaft 396 is positioned concentrically within the hollow axle 440, the hollow axle 440 is concentrically within the pulley 248, the spring 432 contacts the spring seat surface 488 of the hollow axle 440 and the spring face surface 456 of the actuator end 408 of the actuator shaft 396, and the driving surface 460 of the release end 452 of the actuator shaft 396 presses into the frustoconical surface 516 of the elastic wedge 436 such that the engagement surface 512 of the elastic wedge 436 is pressed to the extended position 532. The axle axis 480 and pulley axis 312 are collinear in the locked configuration 548. The engagement surface 512 presses into and contacts the sidewall surface 372 (see FIG. 10) of the slot 360 (see FIG. 10) to hold the assembly 544 in the forward region 388 (see FIG. 10) or the rearward region 392 (see FIG. 10). In some embodiments, the assembly 544 can be positioned between the forward region 388 and the rearward region 392. When assembled in the locked configuration 548, the assembly 544 is configured so that the pulley 248 is configured to rotate about the pulley axis 312, and the actuator shaft 396 intersects the pulley axis 312. When assembled in the locked configuration 548, the pulley 248, the hollow axle 440, the spring 432, and the elastic wedge 436 are all concentrically oriented with respect to the pulley axis 312. The spring 432 presses against the spring seat surface 488 of the hollow axle 440 and the spring face surface 456 of the actuator end 408 so that the actuator end 408 is pressed away from the hollow axle 440 by an outward force 552. When the actuator end 408 is pressed by the outward force 552, the driving surface 460 of the release end 452 presses into the frustoconical surface 516 of the elastic wedge 436, which presses the engagement surface 512 into the extended position 532, thereby engaging and retaining the assembly 544 into the locked configuration 548 within the slot 360. In some embodiments, the engagement surface 512 of the elastic wedge 436 is configured to engage all of the surface of the first rounded end 376 (see FIG. 10) or the second rounded end 380 (see FIG. 10) in the locked configuration 548.

Referring to FIG. 14, the assembly 544 is moved to an unlocked configuration 556 by applying an inward force 560 that overcomes the outward force 552 produced by the spring 432. The inward force 560 is directed along the pulley axis 312 from the actuator end 408 toward the hollow axle 440. When the inward force 560 overcomes the outward force 552 of the spring 432, the actuator end 408 of the actuator shaft 396 moves toward the hollow axle 440 (compare FIG. 13 to FIG. 14), which creates a compression 564 in the spring 432. As the actuator end 408 moves toward the hollow axle 440, the release end 452 moves away from hollow axle 440 and the elastic wedge 436. As the driving surface 460 of the release end 452 ceases pressing against the frustoconical surface 516 of the elastic wedge 436, the elastic wedge 436 changes shape, and the engagement surface 512 retracts from the extended position 532 (see FIG. 13). As the closure mechanism 528 (see FIG. 12) embodied as the engagement surface 512 retracts from the extended position 532, the assembly 544 loses contact with the sidewall surface 372 of the slot 360. In the unlocked configuration 556, the assembly 544 can be removed from the slot 360 altogether, or the assembly 544 is configured to be readily moved between the forward region 388 (see FIG. 10) or the rearward region 392 (see FIG. 10). Therefore, another way to control, adjust and regulate the compression in the midfoot region 110 includes adjusting the position of the lateral pulley 248, the medial pulley 296, or both within their respective slots 360.

It is also contemplated that any of the pulleys 248, 296 may be provided with or modified to include a closure mechanism similar to those disclosed and described in U.S. Pat. Nos. 5,325,613; 5,600,875; 5,606,778; 5,638,588; 5,651,198; and 5,669,116, which are all commonly assigned to Puma SE and incorporated by reference in their entirety herein. It is contemplated that the pulleys 248, 296 may be modified to include the closure mechanisms in place of or in addition to the assembly to provide further tightening functionality and/or audible feedback when used with the cord 268 and mounted on the footwear 200 of the present disclosure.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

I claim:

1. An article of footwear, comprising:

an upper and a sole structure defining a central plane that extends through a toe end and a heel end, wherein the upper has an outward surface;

a plurality of retainers arranged along the upper and intersected by the central plane; and a cord that forms a closed loop, wherein the cord includes an upper segment and a lower segment, wherein the upper segment and the lower segment of the cord are stretched across the outward surface from a heel region to a midfoot region to apply a compression force in the midfoot region to adjust a tightness of the footwear, such that at least one retainer of the plurality of retainers is not engaged by the cord.

2. The article of footwear of claim 1, wherein a distance between the plurality of retainers and the sole structure varies from a first retainer to a second retainer.

3. The article of footwear of claim 2, wherein the upper segment and lower segment of the cord are selectively engaged with the plurality of retainers.

4. The article of footwear of claim 3, wherein, in a first configuration, the cord is configured to engage the first retainer.

5. The article of footwear of claim 4, wherein the upper segment and the lower segment are both configured to engage the first retainer.

6. The article of footwear of claim 3, wherein, in a second configuration, the cord is configured to engage the first retainer and the second retainer.

7. The article of footwear of claim 6, wherein the upper segment is configured to engage the first retainer and the lower segment is configured to engage the second retainer.

8. The article of footwear of claim 3, wherein, in a third configuration, the cord is configured to engage the second retainer.

9. The article of footwear of claim 8, wherein the upper segment and the lower segment are both configured to engage the second retainer.

10. An article of footwear, comprising:

an upper and a sole structure having a midfoot region disposed between a forefoot region and a heel region;

a pulley that is located in the heel region and rotatably attached to an outward surface of the upper, wherein the pulley has an exterior channel having a first sidewall and a second sidewall that are spaced between a circumferential surface; and a cord that is movably coupled to the pulley, wherein the cord has an upper segment and a lower segment connected to one another to form a closed loop that is received in the exterior channel by the first sidewall, the second sidewall, and the circumferential surface, wherein the closed loop is retained on at least one retainer, and wherein the cord is stretched beyond its rest state to exert a compression force on the midfoot region, such that the pulley and the cord are configured to adjust a tightness of the footwear.

11. The article of footwear of claim 10, wherein the pulley includes a first pulley disposed on a medial side of the upper and a second pulley disposed on a lateral side of the upper.

12. The article of footwear of claim 11, wherein the at least one of the first pulley or the second pulley is configured to be translated within a slot formed in the upper.

13. The article of footwear of claim 12, wherein the cord is configured to be selectively engaged with at least one retainer arranged on the upper.

14. An article of footwear, comprising:

an upper and a sole structure defining a central plane that extends through a toe end and a heel end;

a plurality of retainers arranged along the upper, wherein the plurality of retainers are spaced apart from one another and intersected by the central plane;

a pulley that is located in a heel region of the footwear and rotatably attached to an outward surface of the upper, wherein the pulley has an exterior channel having a first sidewall and a second sidewall that are spaced between a circumferential surface; and a cord that is configured to engage at least one of the plurality of retainers and the exterior channel of the pulley, wherein the cord is stretched across the outward surface from the heel region to a midfoot region to apply a compression force in the midfoot region to adjust a tightness of the footwear.

15. The article of footwear of claim 14, wherein the plurality of retainers are disposed in a midfoot region of the footwear.

16. The article of footwear of claim 14, wherein the pulley is rotatable about an axis that is disposed closer to the sole structure relative to the plurality of retainers.

17. The article of footwear of claim 14, wherein a distance is defined between the pulley and each retainer of the plurality of retainers, wherein the distance varies across the plurality of retainers.

18. The article of footwear of claim 14, wherein the cord is configured to be selectively engaged with two retainers of the plurality of retainers and moveably attached to the pulley.

19. The article of footwear of claim 14, wherein the pulley includes a first pulley located on a medial side of the footwear and a second pulley located on a lateral side of the footwear, wherein at least one of the first and second pulleys is configured to be translated and rotated on the upper.

* * * * *